US008138420B2

(12) United States Patent
Amato

(10) Patent No.: US 8,138,420 B2
(45) Date of Patent: Mar. 20, 2012

(54) SEMI-BONDED SHIELDING IN A COAXIAL CABLE

(75) Inventor: Alan John Amato, Cheshire, CT (US)

(73) Assignee: John Mezzalingua Associates, Inc., East Syracuse, NY (US)

( * ) Notice: Subject to any disclaimer, the term of this patent is extended or adjusted under 35 U.S.C. 154(b) by 366 days.

(21) Appl. No.: 12/560,342

(22) Filed: Sep. 15, 2009

(65) Prior Publication Data

US 2011/0061888 A1 Mar. 17, 2011

(51) Int. Cl.
*H01B 7/18* (2006.01)

(52) U.S. Cl. ..... 174/102 R; 174/102 SP

(58) Field of Classification Search ..... 174/36, 174/102 R, 102 SP, 100, 113 R, 117 R, 117 AS, 174/120 R, 121 R
See application file for complete search history.

(56) References Cited

U.S. PATENT DOCUMENTS

| | | | |
|---|---|---|---|
| 2,673,643 | A | 3/1954 | Blank et al. |
| 5,278,356 | A | 1/1994 | Miller |
| 5,593,756 | A | 1/1997 | Miller |
| 6,912,798 | B2 | 7/2005 | Blau et al. |
| 7,244,337 | B2 | 7/2007 | Bahlmann et al. |
| 7,438,964 | B2 | 10/2008 | Clark |

FOREIGN PATENT DOCUMENTS

| | | | |
|---|---|---|---|
| JP | 2002352639 | A | 12/2002 |
| JP | 2004220798 | A | 8/2004 |
| JP | 2004259599 | A | 9/2004 |
| JP | 2008071641 | A | 3/2008 |

OTHER PUBLICATIONS

Application No. PCT/US2010/048919, International Search Report and the Written Opinion of the International Searching Authority, or the Declaration dated May 2, 2011. 8 pages.

PCT's MOCSY® 7 coaxial cable with 1PreP, available at: http://www.pctcorporate.com/images/stories/realtimedox/datasheets/cable/pct_1prep%20mocsy7%20coaxial%20cable%20technology_201002.pdf—accessed on line Sep. 9, 2010.

*Primary Examiner* — William Mayo, III
(74) *Attorney, Agent, or Firm* — Schmeiser Olsen & Watts

(57) ABSTRACT

Semi-bonded shielding in a coaxial cable. In one example embodiment, a coaxial cable includes a center conductor surrounded by a dielectric, an inner conductive tape surrounding the dielectric, a conductive braid surrounding the inner conductive tape, an outer conductive tape surrounding the conductive braid, and a jacket surrounding the outer conductive tape such that the strip of bonding agent semi-bonds the outer conductive tape to the jacket. The outer conductive tape includes an aluminum layer, a polymer layer adjacent to the aluminum layer, and a strip of bonding agent adjacent to the aluminum layer. The strip of bonding agent covers between about 10% and about 33% of a surface of the aluminum layer.

20 Claims, 4 Drawing Sheets

SEMI-BONDED SHIELDING IN A COAXIAL CABLE

BACKGROUND

Typical coaxial cable includes one or more layers of radio frequency (RF) shielding. One common type of shielding is a conductive tape that attenuates interfering electromagnetic fields in the high frequency range. Another common type of shielding is a conductive braid that attenuates interfering electromagnetic fields in the low frequency range. For example, a typical tri-shield coaxial cable includes a center conductor surrounded by a dielectric, an inner tape, a braid, an outer tape, and a jacket.

Prior to the manufacture of a tri-shield coaxial cable, the inner and outer tapes are each shaped as a flat ribbon. During the manufacture of the cable, the inner tape is folded around the dielectric such that the two edges of the inner tape overlap one another to form a straight seam that runs the length of the cable. The braid is next formed around the inner tape, after which the outer tape is folded around the braid such that the two edges of the outer tape overlap one another to form another straight seam that runs the length of the cable. Finally, the jacket is extruded around the outer tape.

After manufacture and prior to use of the tri-shield coaxial cable, the ends of the cable must be terminated with cable connectors. Prior to termination with a cable connector, a quarter-inch section of the center conductor must be exposed by removing all other layers. In addition, immediately adjacent to the quarter-inch section of the exposed center conductor, a quarter-inch section of the jacket and the outer tape must also be removed, thereby exposing a quarter-inch section of the braid. The braid is then folded back over the jacket so that a circular post (or similar structure) of a cable connector can be inserted between the inner tape and the braid.

Some tri-shield coaxial cables are manufactured such that substantially all of the outer surface of the outer tape is bonded to the inner surface of the jacket. One advantage of this bonding is that the quarter-inch section of outer tape can be removed simultaneously with the quarter-inch section of jacket after the jacket is circumscribed with the cutting edge of a cable preparation tool. One drawback of this bonding, however, is that any flexure of the jacket while the coaxial cable is in service causes a corresponding flexure of the outer tape. This flexure of the outer tape causes micro-cracks to develop in the tape which degrades the shielding effectiveness of the tape. Another drawback is that contact with the aluminum in the outer tape tends to wear down the cutting edge of the cable preparation tool.

Other tri-shield cables are manufactured such that the outer tape is not bonded to the jacket. One advantage of not bonding the outer tape to the jacket is that the outer tape can move independently of the jacket during flexure of the jacket, thus decreasing micro-crack degradation of the outer tape. One drawback with not bonding these two layers, however, is that this independent movement of the outer tape tends to cause the two overlapping edges of the outer tape seam to separate during flexure of the jacket. This separation degrades the shielding effectiveness of the outer tape.

SUMMARY OF SOME EXAMPLE EMBODIMENTS

In general, example embodiments of the present invention relate to semi-bonded shielding in a coaxial cable. Some example embodiments include an outer tape that is semi-bonded to a jacket in a coaxial cable using the strip of bonding agent. This semi-bonding allows the unbonded portions of the outer tape to move independently of the jacket during flexure of the jacket. This decreased flexure of the outer tape decreases the flexure-related micro-crack degradation of the outer tape as compared to a cable in which substantially all of the outer surface of the outer tape is bonded to the jacket. In addition, using the strip of bonding agent along one of the overlapping edges of a seam of the outer tape stabilizes the edge during the flexure of the jacket. This stabilization decreases the separation of the two overlapping edges which increases the shielding effectiveness of the outer tape as compared to a cable in which the outer tape is not bonded in any way to the cable jacket.

In one example embodiment, a coaxial cable includes a center conductor surrounded by a dielectric, an inner conductive tape surrounding the dielectric, a conductive braid surrounding the inner conductive tape, an outer conductive tape surrounding the conductive braid, and a jacket surrounding the outer conductive tape such that the strip of bonding agent semi-bonds the outer conductive tape to the jacket. The outer conductive tape includes an aluminum layer, a polymer layer adjacent to the aluminum layer, and a strip of bonding agent adjacent to the aluminum layer. The strip of bonding agent covers between about 10% and about 33% of a surface of the aluminum layer.

In another example embodiment, a coaxial cable includes a center conductor surrounded by a dielectric, an inner conductive tape surrounding the dielectric, a conductive braid surrounding the inner conductive tape, an outer conductive tape surrounding the conductive braid, and a jacket surrounding the outer conductive tape such that the bonding agent semi-bonds the outer conductive tape to the jacket. The outer conductive tape includes an aluminum layer and a bonding agent adjacent to the aluminum layer. The bonding agent covers between about 10% and about 33% of a surface of the aluminum layer.

This Summary is provided to introduce a selection of concepts in a simplified form that are further described below in the Detailed Description. This Summary is not intended to identify key features or essential characteristics of the claimed subject matter, nor is it intended to be used as an aid in determining the scope of the claimed subject matter. Moreover, it is to be understood that both the foregoing general description and the following detailed description of the present invention are exemplary and explanatory and are intended to provide further explanation of the invention as claimed.

BRIEF DESCRIPTION OF THE DRAWINGS

Aspects of example embodiments of the present invention will become apparent from the following detailed description of example embodiments given in conjunction with the accompanying drawings, in which.

DETAILED DESCRIPTION OF SOME EXAMPLE EMBODIMENTS

Example embodiments of the present invention relate to semi-bonded shielding in a coaxial cable. In the following detailed description of some example embodiments, reference will be made in detail to specific embodiments of the present invention, examples of which are illustrated in the accompanying drawings. Wherever possible, the same reference numbers will be used throughout the drawings to refer to the same or like parts. These embodiments are described in sufficient detail to enable those skilled in the art to practice the invention. Other embodiments may be utilized and structural, logical and electrical changes may be made without departing from the scope of the present invention. Moreover, it is to be understood that the various embodiments of the invention, although different, are not necessarily mutually exclusive. For example, a particular feature, structure, or characteristic described in one embodiment may be included within other embodiments. The following detailed description is, therefore, not to be taken in a limiting sense, and the scope of the present invention is defined only by the appended claims, along with the full scope of equivalents to which such claims are entitled.

I. Example Coaxial Cable

Figure 1A:
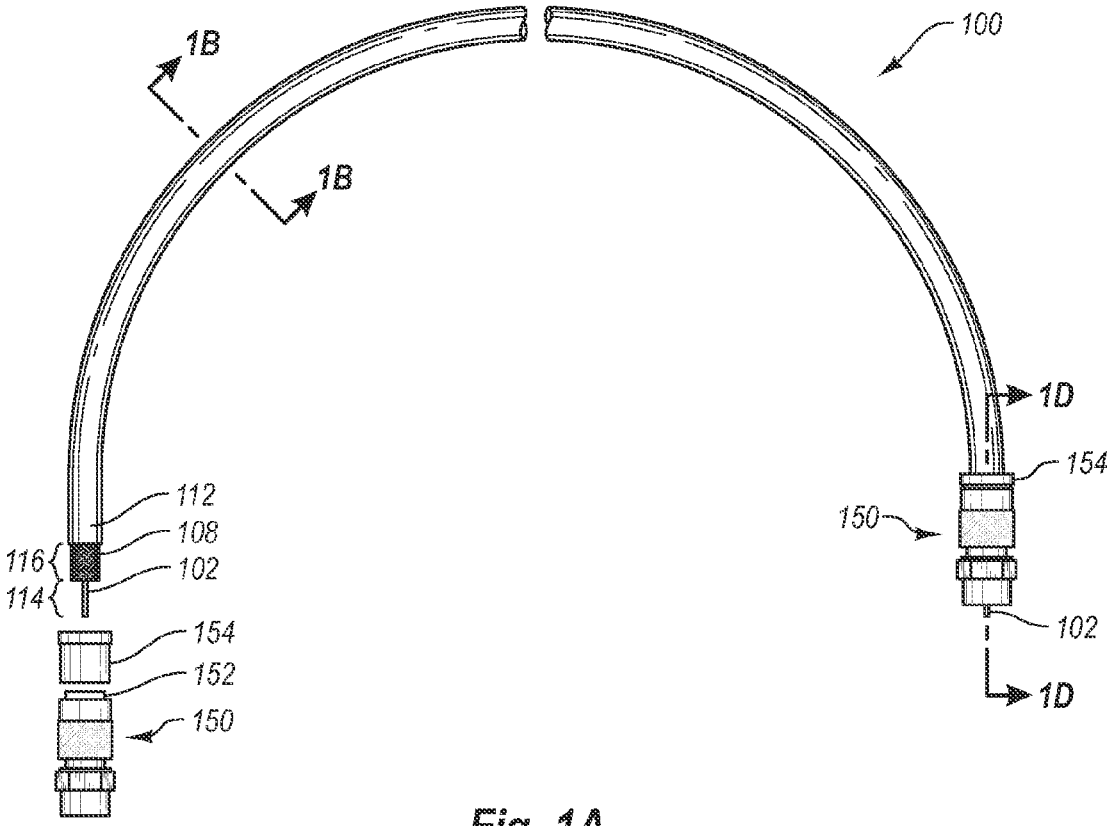
FIG. 1A is a perspective view of an example coaxial cable that terminates on one end with an example connector and that is prepared for termination on the other end with another example connector.

With reference first to FIG. 1A, an example coaxial cable 100 is disclosed. The example coaxial cable 100 can be any type of coaxial cable including, but not limited to, 50 Ohm and 75 Ohm coaxial cable. As disclosed in FIG. 1A, the example coaxial cable 100 is terminated on the right side of FIG. 1A with an example connector 150, and is prepared for termination on the left side of FIG. 1A with a second identical connector 150, as discussed in greater detail below. Although connectors 150 are disclosed in FIG. 1A as F-type male connectors, it is understood that cable 100 can also be terminated with other types of male and/or female connectors (not shown).

Figure 1B:
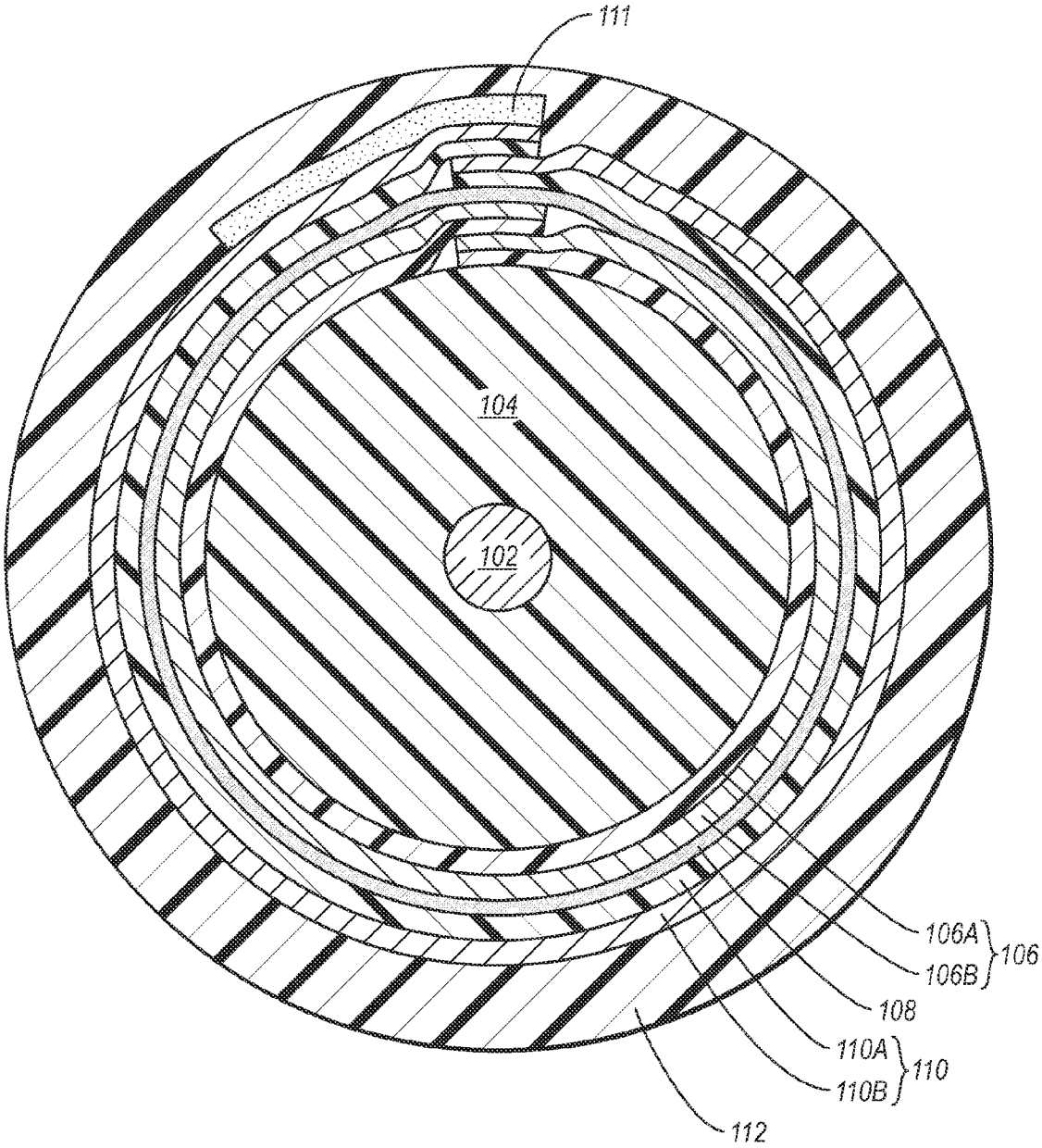
FIG. 1B is a cross-sectional view of the example coaxial cable of FIG. 1A.
Figure 1C:
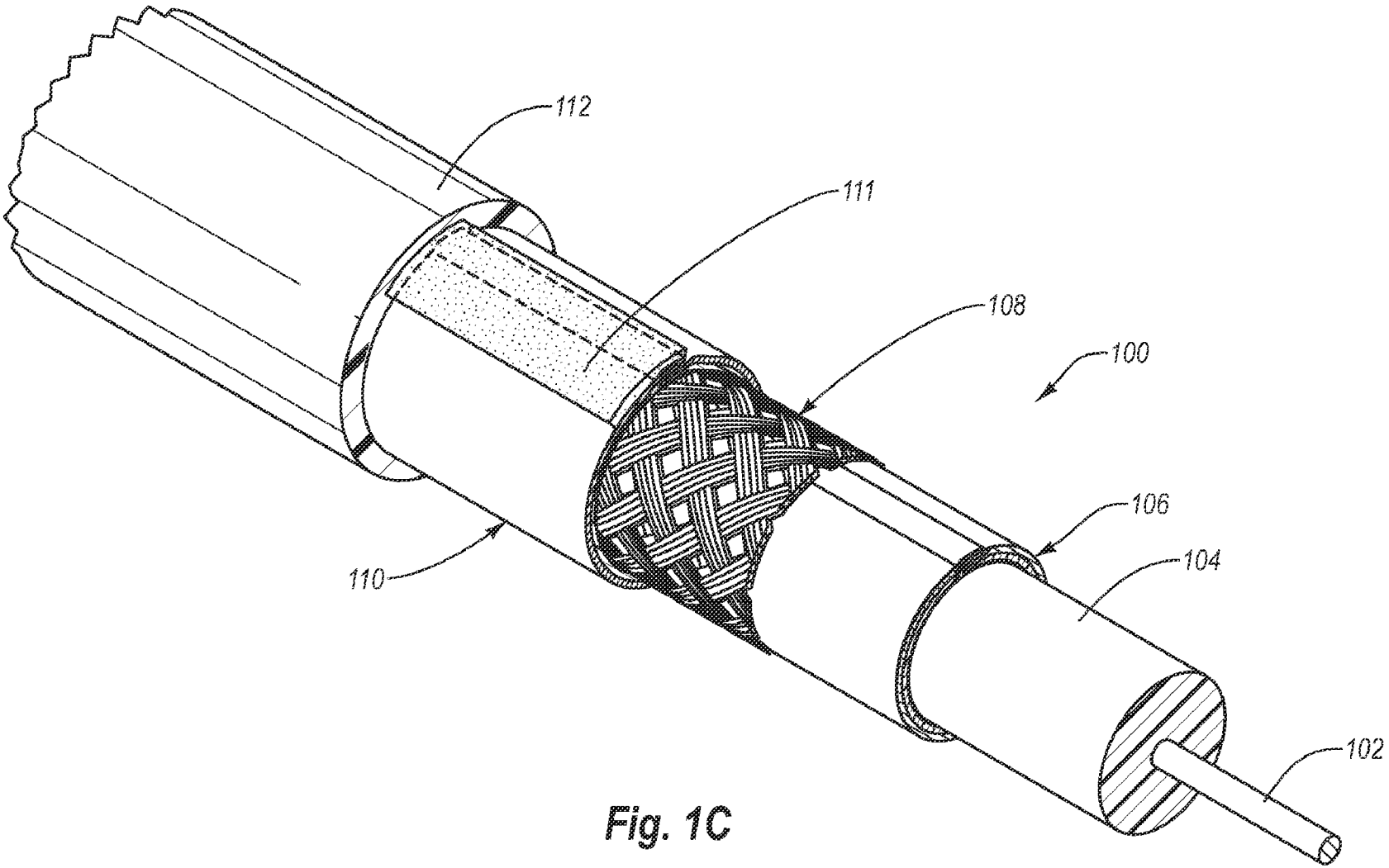
FIG. 1C is a perspective view of a portion of the coaxial cable of FIG. 1A with portions of each layer cut away.

With continuing reference to FIG. 1A, and with reference also to FIGS. 1B and 1C, the coaxial cable 100 is a tri-shield coaxial cable that generally includes a center conductor 102 surrounded by a dielectric 104, an inner tape 106 surrounding the dielectric, a braid 108 surrounding the inner tape 106, an outer tape 110 surrounding the braid 108, and a jacket 112 surrounding the outer tape 110. As used herein, the phrase "surrounded by" refers to an inner layer generally being encased by an outer layer. However, it is understood that an inner layer may be "surrounded by" an outer layer without the inner layer being immediately adjacent to the outer layer. The term "surrounded by" thus allows for the possibility of intervening layers. Each of these components of the example coaxial cable 100 will now be discussed in turn.

The center conductor 102 is positioned at the core of the example coaxial cable 100. The center conductor 102 is configured to carry a range of electrical current (amperes) as well as propagate an RF/electronic digital signal. In some example embodiments, the center conductor 102 is formed from solid copper, copper-clad aluminum (CCA), copper-clad steel (CCS), or silver-coated copper-clad steel (SCCCS), although other conductive materials are possible. For example, the center conductor 102 can be formed from any type of conductive metal or alloy. In addition, the center conductor 102 can be solid, hollow, stranded, corrugated, plated, or clad, for example.

The dielectric 104 surrounds the center conductor 102, and generally serves to support and insulate the center conductor 102 from the inner tape 106. Although not shown in the figures, a bonding agent, such as a polymer bonding agent, can be employed to bond the dielectric 104 to the center conductor 102. In some example embodiments, the dielectric 104 can be, but is not limited to, taped, solid, or foamed polymer or fluoropolymer. For example, the dielectric 104 can be foamed polyethylene (PE).

The inner tape 106 surrounds the dielectric 104, and generally serves to minimize the ingress and egress of high frequency electromagnetic fields to/from the center conductor 102. For example, in some applications, the inner tape 106 can shield against electromagnetic fields that are greater than or equal to about 50 MHz. As disclosed in the figures, the inner tape 106 is a laminate tape that includes a polymer layer 106A and an aluminum layer 106B. However, it is understood that the inner tape 106 can instead include, but is not limited to, the following layers: bonding agent/aluminum/polymer, bonding agent/aluminum/polymer/aluminum, or aluminum/polymer/aluminum, for example. It is understood, however, that the discussion herein of tape is not limited to tape having any particular combinations of layers.

The braid 108 surrounds the inner tape 106, and generally serves to minimize the ingress and egress of low frequency electromagnetic fields to/from the center conductor 102. For example, in some applications, the braid 108 can shield against electromagnetic fields that are less than about 50 MHz. The braid 108 can be formed from inter-woven, fine gauge aluminum or copper wires, such as 34 American wire gauge (AWG) wires, for example. It is understood, however, that the discussion herein of braid is not limited to braid. It may be spiral wrapped or served and formed from any particular type or size of wire.

The outer tape 110 surrounds the braid 108, and generally serves to further minimize the ingress and egress of high frequency electromagnetic fields to/from the center conductor 102, in combination with the inner tape 106. As disclosed in the figures, the outer tape 110 is a laminate tape that includes a polymer layer 110A, an aluminum layer 110B, and a strip of bonding agent 111, as discussed in greater detail below. However, it is understood that the outer tape 110 can instead include, but is not limited to, layers of aluminum/polymer/aluminum/bonding agent, for example.

The jacket 112 surrounds the outer tape 110, and generally serves to protect the internal components of the coaxial cable 100 from external contaminants, such as dust, moisture, and oils, for example. In a typical embodiment, the jacket 112 also functions to protect the coaxial cable 100 (and its internal components) from being crushed or otherwise misshapen from an external force. The jacket 112 can be formed from a relatively rigid material such as, but not limited to, polyethylene (PE), high-density polyethylene (HDPE), low-density polyethylene (LDPE), or linear low-density polyethylene (LLDPE), or some combination thereof. The jacket 112 may instead be formed from a relatively less rigid and more pliable material such as, but not limited to, foamed PE, polyvinyl chloride (PVC), or polyurethane (PU), or some combination thereof. The actual material or combination of materials used might be indicated by the particular application/environment contemplated.

II. Example Semi-Bonding of Shielding in a Coaxial Cable

With continued reference to FIGS. 1B and 1C, the outer tape 110 further includes a strip of bonding agent 111 that is formed along the length of the outer tape 110. The strip of bonding agent 111 covers between about 10% and about 33% of the outer surface of the aluminum layer 110A of the outer tape 110. For example, in some example embodiments, the strip of bonding agent 111 covers about 15% of the outer surface of the aluminum layer 110A of the outer tape 110.

As disclosed in FIGS. 1B and 1C, the strip of bonding agent 111 is positioned along the length of the top overlapping edge of the outer tape 110. However, it is understood that the strip of bonding agent 111 may instead be positioned elsewhere along the length of the outer tape 110. For example, the strip of bonding agent 111 may be positioned about halfway between the two edges of the outer tape 110. Further, although the strip of bonding agent 111 is disclosed in FIGS. 1B and 1C as running in a substantially straight line along the length of the outer tape 110, it is understood that the strip of bonding agent 111 may instead zigzag side to side between the two edges of the outer tape 110 along the length of the coaxial cable 100.

In some example embodiments, the strip of bonding agent 111 can be heat activated during the manufacture of the coaxial cable 100. For example as the jacket 112 is extruded around the outer tape 110, the heat from this extrusion process can activate the strip of bonding agent 111 thereby semi-bonding the outer tape 110 to the jacket 112.

Semi-bonding the outer tape 110 to the jacket 112 using the strip of bonding agent 111 allows the unbonded portions of the outer tape 110 to move independently of the jacket 112 during flexure of the jacket 112. This decreased flexure of the outer tape 110 decreases the flexure-related micro-crack degradation of the outer tape 110 as compared to a cable in which substantially all of the outer surface of the outer tape is bonded to the jacket. In addition, using the strip of bonding agent 111 along one of the overlapping edges of the seam of the outer tape 110 stabilizes the edge during the flexure of the jacket 112. This stabilization decreases the separation of the two overlapping edges which increases the shielding effectiveness of the outer tape 110 as compared to a cable in which the outer tape is not bonded in any way to the cable jacket.

Figure 1D:
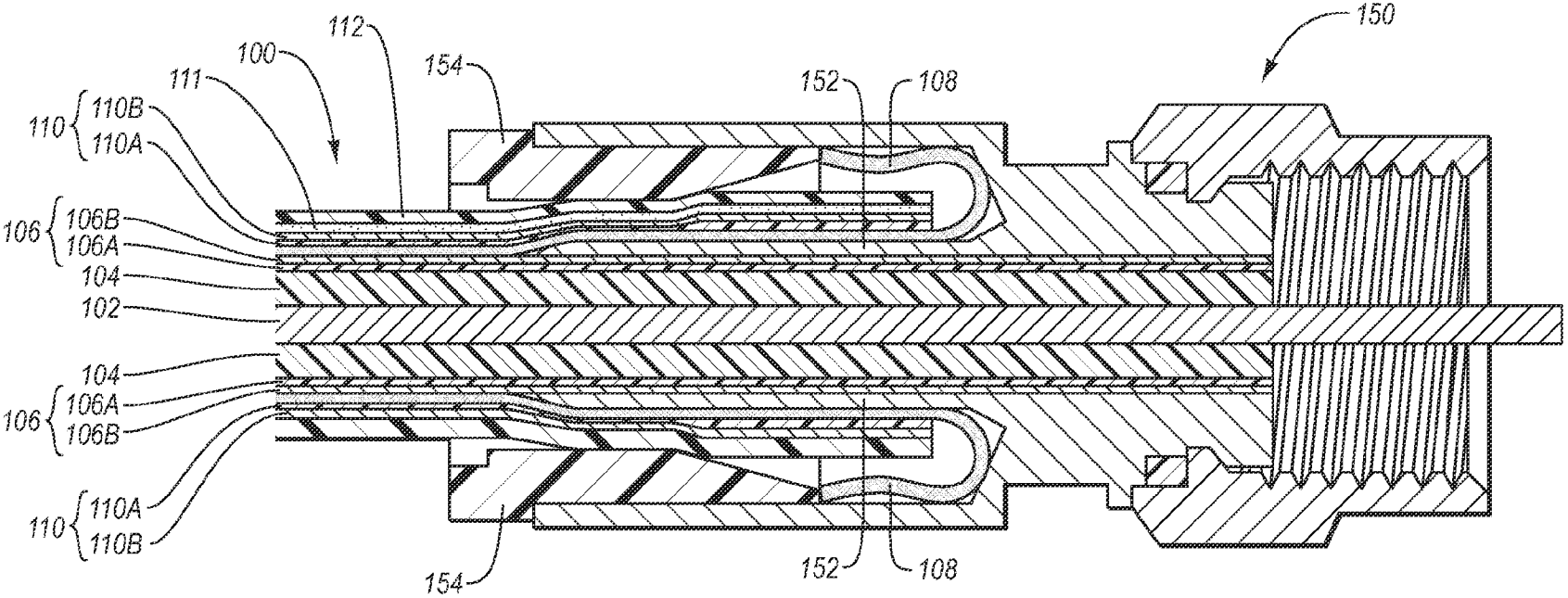
FIG. 1D is another cross-sectional view of the example coaxial cable and one of the example connectors of FIG. 1A.

With reference now to FIG. 1D, and also with reference again to FIG. 1A, aspects of termination of the example cable 100 with the example connector 150 are disclosed. As disclosed on the left side of FIG. 1A, prior to the termination of the example coaxial cable 100 with the connector 150, both a first quarter-inch section 114 of the center conductor 102 and a second quarter-inch section 116 of the braid 108 must be exposed. The second quarter-inch section 116 of the braid 108 is exposed by removing the jacket 112 and the outer tape 110. Semi-bonding the outer tape 110 to the jacket 112 using the strip of bonding agent 111, as disclosed herein, enables the outer tape 110 to be removed simultaneous with the jacket 112 after the jacket 112 is circumscribed with the cutting edge of a cable preparation tool (not shown). This simultaneous removal is generally easier than manually removing the outer tape 110 subsequent to the removal of the jacket 112, as is required in a cable in which the outer tape is not bonded in any way to the cable jacket. The decreased contact with the aluminum layer 110B in the outer tape 110, as disclosed herein, also causes less wear on the cutting edge of the cable preparation tool (not shown) as compared to a cable in which substantially all of the outer surface of the outer tape is bonded to the jacket.

As disclosed in FIGS. 1A and 1D, once the quarter-inch section 116 of the braid 108 is exposed, the exposed portion of the braid 108 can then be folded back over the outside of the jacket 112 so that a circular post 152 (or similar structure) of the cable connector 150 can be inserted between the inner tape 106 and the braid 108. Finally, a wedge portion 154 of the connector 150 can be slid down the coaxial cable 100 to firmly attach the connector 150 to the coaxial cable 100.

The example embodiments disclosed herein may be embodied in other specific forms. The example embodiments disclosed herein are to be considered in all respects only as illustrative and not restrictive.

What is claimed is:

1. A coaxial cable comprising:
a center conductor surrounded by a dielectric;
an inner conductive tape surrounding the dielectric;
a conductive braid surrounding the inner conductive tape;
an outer conductive tape surrounding the conductive braid, the outer conductive tape comprising:
an aluminum layer;
a polymer layer adjacent to the aluminum layer; and
a strip of bonding agent adjacent to the aluminum layer, the strip of bonding agent covering between about 10% and about 33% of a surface of the aluminum layer; and
a jacket surrounding the outer conductive tape such that the strip of bonding agent semi-bonds the outer conductive tape to the jacket.

2. The coaxial cable as recited in claim 1, wherein the strip of bonding agent covers about 15% of a surface of the aluminum layer.

3. The coaxial cable as recited in claim 1, wherein the outer conductive tape further comprises a second aluminum layer adjacent to the polymer layer and opposite the aluminum layer.

4. The coaxial cable as recited in claim 1, wherein the strip of bonding agent runs in a substantially straight line along the length of the outer conductive tape.

5. The coaxial cable as recited in claim 1, wherein the strip of bonding agent zigzags side to side between two edges of the outer conductive tape along the length of the outer conductive tape.

6. The coaxial cable as recited in claim 1, further comprising a second bonding agent bonding the dielectric to the center conductor.

7. The coaxial cable as recited in claim 1, wherein the inner conductive tape comprises a second polymer layer adjacent to a second aluminum layer.

8. The coaxial cable as recited in claim 7, wherein the inner conductive tape further comprises a third aluminum layer adjacent to the second polymer layer and opposite the second aluminum layer.

9. The coaxial cable as recited in claim 8, wherein the inner conductive tape further comprises a second bonding agent adjacent to either the second aluminum layer or the third aluminum layer.

10. The coaxial cable as recited in claim 1, wherein the strip of bonding agent is positioned along a length of an overlapping edge of the outer conductive tape.

11. The coaxial cable as recited in claim 1, wherein the strip of bonding agent is positioned about halfway between the two edges of the outer conductive tape.

12. A coaxial cable comprising:
a center conductor surrounded by a dielectric;
an inner conductive tape surrounding the dielectric;
a conductive braid surrounding the inner conductive tape;
an outer conductive tape surrounding the conductive braid, the outer conductive tape comprising:
an aluminum layer; and
a bonding agent adjacent to the aluminum layer, the bonding agent covering between about 10% and about 33% of a surface of the aluminum layer; and
a jacket surrounding the outer conductive tape such that the bonding agent semi-bonds the outer conductive tape to the jacket.

13. The coaxial cable as recited in claim 12, wherein the bonding agent covers about 15% of a surface of the aluminum layer.

14. The coaxial cable as recited in claim 12, wherein the outer conductive tape further comprises a polymer layer adjacent to the aluminum layer and opposite the bonding agent.

15. The coaxial cable as recited in claim 14, the outer conductive tape further comprises a second aluminum layer adjacent to the polymer layer and opposite the aluminum layer.

16. The coaxial cable as recited in claim 12, wherein the bonding agent runs in a substantially straight line along the length of the outer conductive tape.

17. The coaxial cable as recited in claim 12, wherein the bonding agent zigzags side to side between two edges of the outer conductive tape along the length of the outer conductive tape.

18. The coaxial cable as recited in claim 12, wherein the bonding agent is positioned along a length of an overlapping edge of the outer conductive tape.

19. The coaxial cable as recited in claim 12, wherein the bonding agent is positioned about halfway between the two edges of the outer conductive tape.

20. The coaxial cable as recited in claim 12, wherein the bonding agent is a heat-activated polymer bonding agent that is capable of being heat activated during the manufacture of the coaxial cable as the jacket is extruded around the outer conductive tape in order to semi-bond the outer conductive tape to the jacket.

* * * * *